US008581084B2

(12) United States Patent
Pouyania

(10) Patent No.: US 8,581,084 B2
(45) Date of Patent: Nov. 12, 2013

(54) TEMPO COUNTER DEVICE

(76) Inventor: Iman Pouyania, Tehran (IR)

( * ) Notice: Subject to any disclaimer, the term of this patent is extended or adjusted under 35 U.S.C. 154(b) by 0 days.

(21) Appl. No.: 13/179,531

(22) Filed: Jul. 10, 2011

(65) Prior Publication Data

US 2013/0008300 A1 Jan. 10, 2013

(51) Int. Cl.
*G10H 3/00* (2006.01)

(52) U.S. Cl.
USPC ..... 84/612; 84/636; 84/652; 84/668

(58) Field of Classification Search
USPC ..... 84/612, 636, 652, 668
See application file for complete search history.

(56) References Cited

U.S. PATENT DOCUMENTS 3,553,334 A * 1/1971 Freeman ..... 84/668
4,028,879 A * 6/1977 Moegen et al. ..... 368/187
4,089,246 A * 5/1978 Kooker ..... 84/470 R
4,144,788 A * 3/1979 Bione et al. ..... 84/611
4,297,934 A * 11/1981 Imamura et al. ..... 84/477 R
4,300,225 A * 11/1981 Lambl ..... 369/2
4,319,509 A * 3/1982 Machanian ..... 84/612
4,402,244 A * 9/1983 Nakada et al. ..... 84/612
4,484,507 A * 11/1984 Nakada et al. ..... 84/612
4,587,878 A * 5/1986 Nakada et al. ..... 84/613
4,602,544 A * 7/1986 Yamada et al. ..... 84/609
4,889,026 A * 12/1989 Abe ..... 84/611
4,916,742 A * 4/1990 Kolesnikov et al. ..... 704/215
5,070,758 A * 12/1991 Katada et al. ..... 84/634
5,247,128 A * 9/1993 Suzuki ..... 84/611
5,585,586 A * 12/1996 Wakuda ..... 84/636
8,071,869 B2 * 12/2011 Chen et al. ..... 84/612
2002/0148347 A1 * 10/2002 Herberger et al. ..... 84/636
2009/0019994 A1 * 1/2009 McKinney ..... 84/612
2010/0282045 A1 * 11/2010 Chen et al. ..... 84/612

* cited by examiner

*Primary Examiner* — David S. Warren
(74) *Attorney, Agent, or Firm* — Barry Choobin; Patent 360 LLC

(57) ABSTRACT

The embodiments herein provide a beat counter device for sampling a plurality of voice samples by differentiating tempos from each other in a selected rhythm. The beat counter device comprises a seven segment indicator, a display unit, at least one directional key, an adjustment wheel, a volume button, an ON/OFF button, a microphone, a microphone port and a head phone port. The pressing operation of the ON/OFF button results in the microphone to perform a sampling of voices samples by separating a tempo from another tempo associated with a selected rhythm. The seven-segment indicator counts the number of tempos in the selected rhythm in each multi-measure time signature. The sampled voices are outputted through the headphone port.

17 Claims, 3 Drawing Sheets

TEMPO COUNTER DEVICE

BACKGROUND

1. Technical Field

The embodiments herein generally relate to a voice-sampling device and particularly relate to a beat counter device for sampling one or more voices recorded or played. The embodiments herein more particularly relate to a sampling of one or more voices by separating a tempo from another tempo, which are associated with a selected rhythm.

2. Description of the Related Art

In the existing techniques, a vocal sample is needed by a musician to identify the beats in the sound. However when the orchestra is small and the number of the musical instruments in the orchestra is less, then the beats in the sound cannot be identified.

Further in the existing techniques, some of the music bits begin with a silence and also the musical instruments have a number of silent taps in certain parts of the sound piece, which cannot be detected. Currently, the sound is transferred outside of the musical instrument players' headphone and then again transferred back towards the tables through the studio's microphone. Consequently when the sound of an instrument is SOLO or when the orchestra performs with piano dynamics then an undesired sound consisting of additional voices is produced which in turn reduce the quality of the sound.

Hence there is a need to provide a device for sampling one or more voices samples by separating a tempo from another tempo that are associated with a particular rhythm. There is also a need to provide a device for sampling one or more voice samples by eliminating an undesired noise from the voice samples. Further there is a need to provide a device for sampling one or more voice samples to enable a music instructor to teach blind and deaf people.

The abovementioned shortcomings, disadvantages and problems are addressed herein and which will be understood by reading and studying the following specification.

OBJECTS OF THE EMBODIMENTS

The primary object of the embodiments herein is to provide a beat counter device, which automatically samples the one or more voices samples by eliminating the undesirable noises in an environment from the one or more voices.

Another object of the embodiments herein is to provide a beat counter device, which enhances the quality of voice recording.

Yet another object of the embodiments herein is to provide a beat counter device, which is adapted to function as an analyzer meter in a musical score.

Yet another object of the embodiments herein is to provide a beat counter device to sample voice pieces in real time.

Yet another object of the embodiments herein is to provide a beat counter device to record the ensemble in orchestras in minimum time.

Yet another object of the embodiments herein is to provide a beat counter device adapted for coordinating an orchestra in minimum time in performing rhythm of musical works.

Yet another object of the embodiments herein is to provide a beat counter device, which enables music teachers for instructing the music rhythm to the students.

Yet another object of the embodiments herein is to provide a beat counter device contriving special abilities to teach deaf and blind music students.

Yet another object of the embodiments herein is to provide a beat counter device adapted to record and register a musical work as a project.

Yet another object of the embodiments herein is to provide a beat counter device with an option to edit the voice samples and perform the sound samples with a high level of accuracy.

Yet another object of the embodiments herein is to provide a beat counter device, which can be used in analog music studios.

Yet another object of the embodiments herein is to provide a beat counter device for completion of voice mixing in digital music studios.

Yet another object of the embodiments herein is to provide a beat counter device to control different music tempo figures.

These and other objects and advantages of the present invention will become readily apparent from the following detailed description taken in conjunction with the accompanying drawings.

SUMMARY

The embodiments herein provide a beat counter device for sampling a plurality of voices samples. The beat counter device includes a seven-segment indicator, a display unit, one or more directional keys, an adjustment wheel, a volume button, an ON/OFF button, a microphone, a microphone port, and a headphone port. When the ON/OFF button of the device is pressed to turn ON the device, the microphone initiates the sampling of the plurality of voice samples separating a tempo from another tempo, which are associated with a selected rhythm. The number of tempos in the selected rhythm is counted in each multi-measure time signature through the seven-segment indicator and the sampled voices are output through the headphone port.

According to an embodiment herein, the plurality of voice samples are sampled in real time based on the voice intensity of the tempos.

According to an embodiment herein, the selected rhythm comprises at least one of a simple time signature, a compound time signature, and a mixed time signature.

According to an embodiment herein, the microphone enhances the quality of the plurality of the voice samples recorded.

According to an embodiment herein, the microphone port is connected to an inlet port of a Tip Ring Sleeve (TRS) connector to transfer the one or more voices sampled.

According to an embodiment herein, the headphone port is used for hearing the sound of tempos and the structure of the projects saved and defined.

According to an embodiment herein, the seven-segment indicator counts the number of tempos by detecting at least one of the simple time signature, the compound time signature, and the mixed time signature.

According to an embodiment herein, the seven-segment indicator displays the number of tempos counted in the plurality of voices samples.

According to an embodiment herein, the display unit displays a plurality of administrative stages involved in sampling of the plurality of voices samples in different menus.

According to an embodiment herein, the one or more directional keys comprises at least one of a left key, a value down key, a value up key, a right key and an enter key.

According to an embodiment herein, the adjustment wheel facilitates in counting the number of tempos involved in the plurality of voice samples.

According to an embodiment herein, the adjustment wheel provides for shifting among the plurality of administrative stages involved in sampling the plurality of voice samples in different menus.

According to an embodiment herein, the ON/OFF button initiates or stops the operation of the device.

According to an embodiment herein, the volume button is used for increasing and decreasing the volume on the sampled voice outputted through the head phone port.

According to an embodiment herein, the beat counter device includes a sampler circuit for sampling the plurality of voice samples.

According to an embodiment herein, the sampler circuit classifies the plurality of voice samples into a high strength voice samples and a low strength voice samples during the sampling operation.

According to an embodiment herein, the sampler circuit samples the plurality of voice samples in at least one of a play mode and a record mode.

According to an embodiment herein, the plurality of sampled voices is stored as a project in a wave format in the memory.

According to an embodiment herein, the tempos of the plurality of sampled voices are altered by changing the speed of the sound.

According to an embodiment herein, the one or more directional keys comprises at least one of a left key, a value down key, a value up key, a right key and an enter key.

These and other objects and advantages of the present invention will become readily apparent from the following detailed description taken in conjunction with the accompanying drawings.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
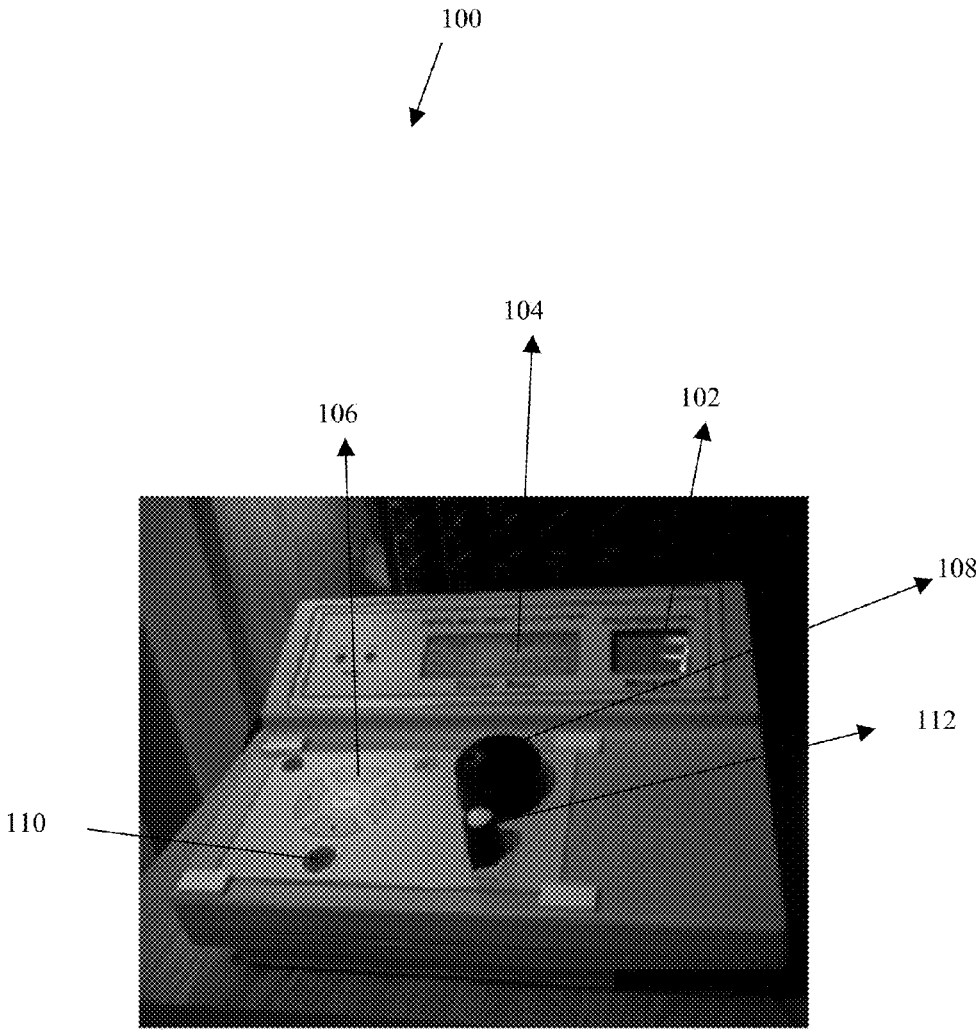
FIG. 1 illustrates a front view of a beat counter device, according to an embodiment of the present disclosure.

Although the specific features of the embodiments herein are shown in some drawings and not in others. This is done for convenience only as each feature may be combined with any or all of the other features in accordance with the embodiment herein.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The embodiments herein provide a beat counter device, which automatically measure the beats and calculate the beats per minute of a plurality of voice samples played. The beat counter device includes a seven-segment indicator, a display unit, one or more directional keys, an adjustment wheel, a volume button, an ON/OFF button, a microphone, a microphone inlet port, and a headphone port. The device is contrived with the microphone embedded within the internal circuitry of the device with a microphone inlet port provided exteriorly on the device. The headphone port is also installed exterior of the device. The pressing operation of the ON/OFF button results in the microphone to perform sampling of the plurality of voice samples by separating a tempo from another tempo that are associated with a selected rhythm.

The number of tempos in the particular rhythm is counted and displayed through the seven-segment indicator and the sampled voice signals are outputted through the headphone port.

The pluralities of voice samples are sampled in real time based on voice intensity of the tempos. The selected rhythm comprises at least one of a simple time signature, a compound time signature, and a mixed time signature.

The microphone enhances the quality of the plurality of voice samples recorded. The microphone port is connected to an inlet port of a Tip ring sleeve (TRS) connector to transfer the sampled voices. The TRS connector is a common analog audio connector. The sampled voices are transferred to the plurality of audio/voice mixers. The headphone port is used for hearing the sound of tempos and the structure of the projects saved and defined. The seven-segment indicator counts the number of tempos by measuring at least one of the simple time signature, the compound time signature, and the mixed time signature. The seven-segment indicator displays the number of tempos counted in the one or more voice samples.

The display unit displays a plurality of administrative stages involved in sampling the plurality of voice samples in different menus.

The adjustment wheel facilitates in counting the number of tempos involved in the one or more voices. The adjustment wheel provides an option for shifting among the plurality of administrative stages involved in sampling the voices samples in different menus.

The volume button is used for increasing and decreasing the volume of the voice samples outputted through the head phone port.

The beat counter device includes a sampler circuit for sampling the voices samples. The sampler circuit classifies the plurality of voices samples into a high strength voice and a low strength voice during sampling operation. The sampled voices are stored as a project in various formats in the memory.

The one or more voices sampled are transferred to a plurality of external devices through a sound cable. The tempo of the one or more voices sampled is altered by changing the speed of the sound.

FIG. 1 illustrates a front view of a beat counter device, according to an embodiment of the present disclosure. With respect to FIG. 1, the beat counter device includes a seven-segment indicator 102, a display unit 104, one or more directional keys 106, an adjustment wheel 108, an ON/OFF button 110 and a volume button 112.

The seven segment indicator 102 displays the number of tempos counted in the plurality of voice samples. The display unit 104 displays a plurality of administrative stages involved in sampling the plurality of voices in different menus. The one or more directional keys 106 comprises at least one of a left key, a value down, a value up, a right and an enter key. The adjustment wheel 108 facilitates in counting the number of tempos involved in the one or more voices. The adjustment wheel 108 provides an option to a user for shifting among the plurality of administrative stages involved in sampling the plurality of voices in different menus.

The ON/OFF button 110 is adapted to initiate or terminate the operation of sampling the plurality of voice samples. The volume button 112 is used for increasing and decreasing the volume on the head phone port 204.

The device further includes a microphone inbuilt within the beat counter device for sampling the plurality of voice samples. The pressing operation of the ON/OFF button 110 triggers the microphone to perform a sampling of the plurality of voice samples by separating a tempo from another tempo that are associated with a particular rhythm. The number of tempos in the particular rhythm is counted in each measure through the seven segment indicator 102 and the sampled voice signals are output to the external devices through any suitable communication media.

The beat counter device 100 samples the plurality of voice samples based on the intensity of sound. The selected rhythm includes a simple time signature, a compound time signature, and a mixed time signature. Further each signature includes two tempos and the rhythm is distinguished by separating tempos from each other based on voice intensity. However in a two tempo time signature, when the first tempo is performing stronger than the second tempo, then the two-tempo time signature is characterized and the listener/hearer is able to recognize that the time signature is a two tempo signature. The beat counter further includes two LED lights contrived adjacent to the display unit 104. When the time signature is a two tempo signature, then the two LED lights provided in the device shows the corresponding colours. The colour indication in turn provides the deaf people to recognize the tempos involved in the voice sample.

The beat counter device 100 is programmed using high IC Micro control technology with 0.00005 sec accuracy of producing rhythm based on the operator requirements. The beat counter device 100 has the capability to sample 10 types of voice in real time to play the sound of related forces.

Figure 2:
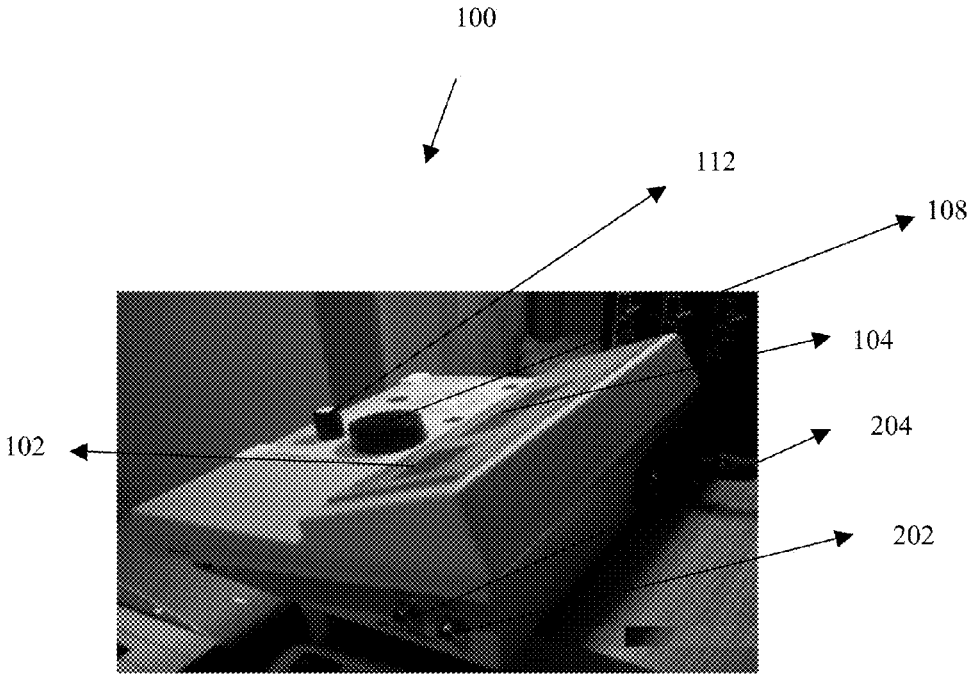
FIG. 2 illustrates a side view of a beat counter device, according to an embodiment of the present disclosure.

FIG. 2 illustrates a side view of a beat counter device, according to one embodiment of the present disclosure. With respect to FIG. 2, the beat counter includes a microphone port 202, a head phone port 204, a seven segment indicator 102, a display unit 104, one or more directional keys 106, an adjustment wheel 108, an ON/OFF button 110 and a volume button 112.

The microphone port 202 is connected to an inlet port of a TRS connector to transfer the plurality of sampled voices. The headphone port 204 is used for hearing the sound of tempos and the structure of the projects saved and defined. The seven-segment indicator 102 counts the number of tempos by detecting at least one of the simple time signature, the compound time signature, and the mixed time signature. The seven segment indicator 102 displays the number of tempos counted in the voice samples.

The sampled output voices are stored as a project in various formats such as a wave format in the memory. Further an auxiliary output is used for performing defined projects on the mixing console in music studios with wave format. The auxiliary output of the beat counter device is only a vocal signal and is heard through the headphone or transferred through a sound cable to a voice mixer. The vocal signal is transferred to the voice mixer by pressing the ON/OFF button 110.

The display unit 104 displays a plurality of administrative stages involved in sampling the one or more voices in different menus. The display unit 104 is the LCD. The LCD includes different menu.

The beat counter device counter 100 samples the plurality of voice samples in at least one of a play mode and a record mode. Further when the beat counter device 100 is turned on, two options are displayed on the display unit 104. The two options are the play mode and the record mode. The user or the operator of the beat counter device needs to select the mode of operation.

Further if the user selects the play mode in the beat counter device 100, then a plurality of options are displayed to the user. The pluralities of options include but are not limited to a NEW PROJECT, an OPEN PROJECT, and a DELETE PROJECT. The NEW PROJECT option is selected for defining a new project or entering the default page of the device. The OPEN PROJECT option is selected for loading the saved projects and entering project list and choosing tended project. The DELETE PROJECT option is selected for deleting a saved project from the project list. The enter key is pressed to select different stages in different menus.

Further if the user selects the record mode in the beat counter device 100, then the user gets access to a menu with an option SELECT HIGH AND LOW SOUND THEN PUSH ENTER in the display unit. The one or more directional keys 106 are pushed up or down to enter the next page or previous page. The user is provided an option SAVE to store the project. Further after pressing an enter key, the intended projects are loaded and a plurality of options are provided for the project as mentioned below.

TEMPO: This option is related to speed alternations in different time signatures, which can change from 30 to 300 counts.

VOICE: This option is related to the selection of recorded samples for broadcasting voice of beats. The user selects this option to broadcast the sound to various analog and digital music studios.

METER: This option is related to identifying weak and strong tempos from the plurality of signatures. The METER starts blinking, when the weak and strong tempos are detected in the plurality of signatures. Further by pushing the ENTER key the user gets an access to edit weak and strong tempos and then by pushing START/STOP key, the selected time signature with the selected sample and tempo is performed.

MEASURE COUNTER: This option is used for defining the total number of intended measures. The intended measures are defined by moving the one or more directional keys and the rotate shuttle.

PAGE1/A: This option is related to device's parameters and the altering the rhythm by changing the speed. Further all the changes to the rhythm are defined in different pages and saved in lasting memory as a project. So all the existing parameters in PAGE1/A can change and it can be different for each page such as PAGE1/A, PAGE2/A, and PAGE3/A.

INSERT: This option is applied for performing the last tempo of each measure for simultaneous and accurate arrives of the orchestra in the beginning of the next measure.

NEXT PAGE: This sign is used for making the operator conscious of the existence of another page other than the device's default page. Further the operator can enter the second page by DOWN arrow key.

PAGE1/B: This option is similar to PAGE1/A. Further in this page the possibility of defining all the agogic changes of the speed is provided.

SAVE: The user is provided an option SAVE to store the project. The operator can define all the defined cases as a project in the lasting memory and select the SAVE option to store the projects. The user assigns a desired name to the project and the ENTER key is pressed to store the project.

BEFORE PROJECT: This sign is used for indicating the operator for turning back to the previous page, so the operator can enter the first page by using up arrow key.

Figure 3:
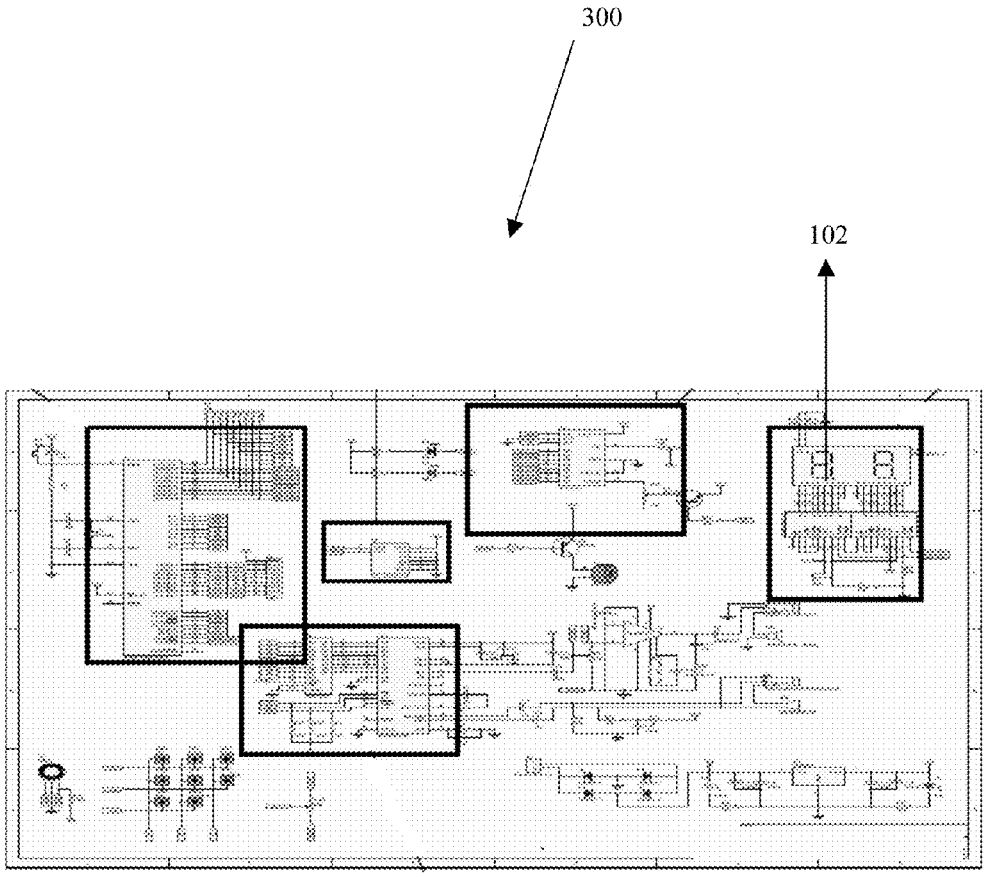
FIG. 3 illustrates a schematic view of a sampler circuit in the beat counter device, according to an embodiment of the present disclosure.

FIG. 3 illustrates a schematic view of a sampler circuit in the beat counter, according to an embodiment of the present disclosure. With respect to FIG. 3, the beat counter device includes a sampler circuit 300 for sampling the plurality of voices signals. The sampler circuit 300 classifies the plurality of voice samples into a high strength voice and a low strength voice during sampling operation. The sampler circuit 300 samples the voices in at least one of a play mode and a record mode.

The beat counter device 100 includes two LEDs that are used to determine a weak tempo and a strong tempo in the plurality of signatures. The plurality of time signature includes the simple time signature, the compound time signature and the mixed time signature. The mixed time signature includes two or more unequal time signatures. The determination of weak tempo and the strong tempos in the one or more voices are monitored by the operator. The intensity of tempos is changed from a weak to strong and vice versa and the strong tempos are represented as HH (HIGH) and the weak tempos are represented by LL (LOW). The weak tempo and the strong tempos are identified in the plurality of signatures based on the blinking of the red and blue LEDs. Further the weak tempo and the strong tempos are also identified by counting the number of beats displayed in the seven-segment indicator.

The various advantages of the present disclosure are to provide the beat counter device that samples the one or more voices by eliminating undesirable noises in the environment from the one or more voices. The beat counter device also enhances the quality of voice recording and records the voices or sounds in orchestras with minimum time. The beat counter device provides an option to output the sampled music sample from stereos sound cable to music studios input in a wave format. The beat counter device also provides an option to edit the sound samples and perform the sound samples with accuracy equal to 50 microseconds.

The beat counter device is completely portable and does not require any hardware, software and accessories for operation. Further even the users not familiar with different software's and minimal computer knowledge can use the beat counter device efficiently.

The beat counter device is used by the musical instructor to instruct the blind and deaf students. The beat counter device includes the seven segment indicator for instructing the category of rhythm or the different time signatures to the deaf students. The deaf students categorized the rhythm based on the time signatures displayed in the seven segment indicator. The beat counter device includes red and blue LED for detecting strong and weak beats in different time signatures though the seven segment indicator. This helps the deaf students to separate strong and weak tempos in the multi-measure time signatures.

The foregoing description of the specific embodiments herein will so fully reveal the general nature of the embodiments herein that others can, by applying current knowledge, readily modify and/or adapt for various applications such specific embodiments herein without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the embodiments herein with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A device comprising:

a seven segment indicator;

a display unit;

at least one directional key;

an adjustment wheel;

a volume button;

an ON/OFF button;

a microphone;

a microphone port; and a head phone port;

wherein a pressing operation of the ON/OFF button results in the microphone to perform a sampling of voices samples by separating one tempo from another tempo associated with a selected rhythm and the seven segment indicator counts the number of tempos in the selected rhythm in each multi-measure time signature and the sampled voices are output through the head phone port.

2. The device of claim 1, further comprises a sampler circuit for sampling a plurality of voice samples.

3. The device of claim 1, wherein the plurality of voice samples are sampled in real time based on voice intensity of the tempos.

4. The device of claim 1, wherein the time signature comprises at least one of a simple time signature, a compound time signature, and a combination of the simple time signature and the compound time signature.

5. The device of claim 1, wherein the microphone port is connected to an inlet port of a Tip Ring Sleeve (TRS) connector to transfer the plurality of sampled voices.

6. The device of claim 1, wherein the seven segment indicator counts the number of tempos by measuring at least one of the simple time signature, the compound time signature, and the combination of the simple time signature and the compound time signature.

7. The device of claim 1, wherein the seven segment indicator displays the number of tempos counted in the each of the plurality of voice samples.

8. The device of claim 1, wherein the display unit displays a plurality of administrative stages involved in the sampling of the plurality of voice samples in different menu.

9. The of claim 1, wherein the one or more directional keys comprises at least one of a left key, a value down key, a value up key, a right key and an enter key.

10. The device of claim 1, wherein the adjustment wheel facilitates in counting the number of tempos involved in the plurality of voice samples.

11. The device of claim 1, wherein the adjustment wheel provides for drifting through the plurality of administrative stages involved in sampling the plurality of voices samples in different menus.

12. The device of claim 1 wherein the ON/OFF button provides for starting and stopping the sampling operation of the plurality of voice samples.

13. The device of claim 2, wherein the sampler circuit classifies the plurality of voice samples into a high strength voices and a low strength voices during a sampling operation.

14. The device of claim 2, wherein the sampler circuit samples the plurality of voice samples in at least one of a play mode and a record mode.

15. The device of claim 1, wherein the plurality of sampled voices are stored as a project in a wave format in a memory.

16. The device of claim 1, wherein the microphone alters the tempo of the plurality of sampled voices by changing a speed of the sound.

17. The device of claim 1, further comprising an auxiliary output line to transfer the plurality of sampled voices to a voice mixer.

* * * * *